US007914705B2

(12) United States Patent
Sisson

(10) Patent No.: US 7,914,705 B2
(45) Date of Patent: Mar. 29, 2011

(54) FLOWABLE ELECTRICAL CONDUCTIVE LIQUID

(76) Inventor: Robert Eliot Sisson, Nichols Hills, OK (US)

( * ) Notice: Subject to any disclaimer, the term of this patent is extended or adjusted under 35 U.S.C. 154(b) by 1053 days.

(21) Appl. No.: 11/032,296

(22) Filed: Jan. 10, 2005

(65) Prior Publication Data

US 2006/0155033 A1 Jul. 13, 2006

(51) Int. Cl.
*C10M 119/00* (2006.01)
*H01B 5/00* (2006.01)
*H01B 1/12* (2006.01)

(52) U.S. Cl. ..... 252/500; 252/512; 508/123; 508/131; 508/150; 508/591; 174/126.1; 174/126.2; 29/33 M

(58) Field of Classification Search ..... 252/503, 252/513, 514, 519.2, 500, 512, 518.1; 437/587, 437/936; 524/398, 403, 495, 439, 496; 508/113, 508/141, 150, 123, 167, 136; 439/587, 936; 428/421
See application file for complete search history.

(56) References Cited

U.S. PATENT DOCUMENTS 3,630,901 A * 12/1971 Messina et al. ..... 508/181
3,928,214 A * 12/1975 Naka et al. ..... 508/123
5,773,394 A * 6/1998 Wan et al. ..... 508/591
5,783,113 A * 7/1998 Nayak et al. ..... 252/512
5,962,122 A 10/1999 Walpita
6,500,027 B1 12/2002 Van Der Sanden
6,825,429 B2 11/2004 Dove
6,833,405 B1 12/2004 Cottis
2003/0158047 A1 * 8/2003 Denpo et al. ..... 508/113

OTHER PUBLICATIONS

Prohm-tect web site located at http://www.prohm-tect.com including MSDS sheet located on that web site and cover page, 1971.

* cited by examiner

*Primary Examiner* — Stanley Silverman
*Assistant Examiner* — Kallambella Vijayakumar
(74) *Attorney, Agent, or Firm* — Martin G. Ozinga; Phillips Murrah PC

(57) ABSTRACT

A liquid borne emulsion of varying formulations comprising a powdered metal in a base liquid incorporating a thickening agent component is adapted to a specific metal and type of electrical connection in a specific environment to enhance the electrical conductivity at the electrical connection, reducing the effect of the environment over time of the metals within the electrical connection, increasing the surface area of the electrical connection, reducing the effect of vibration upon the electrical connection to prevent separation and loss of contact to the electrical connection and reducing the signal noise generated by metal to metal movement resulting from an imperfect contact in an electrical connection.

1 Claim, No Drawings

FLOWABLE ELECTRICAL CONDUCTIVE LIQUID

CROSS REFERENCE TO RELATED APPLICATIONS

None

I. BACKGROUND OF THE INVENTION

1. Field of Invention

A liquid borne emulsion of varying formulations comprising a powdered metal in a base liquid incorporating a thickening agent component is adapted to a specific metal and type of electrical connection in a specific environment to enhance the electrical conductivity at the electrical connection, reducing the effect of the environment over time of the metals within the electrical connection, increasing the surface area of the electrical connection, reducing the effect of vibration upon the electrical connection to prevent separation and loss of contact to the electrical connection and reducing the signal noise generated by metal to metal movement resulting from an imperfect contact in an electrical connection.

2. Description of Prior Art

The following United States patents were discovered and are disclosed within this application for utility patent. While none of them appear to be prior art, they may not be in the same art group as the present invention may ultimately be assigned, as they do not appear to involve the same intent as the present invention, nor do they address a solution to the problems solved by the present invention.

A first U.S. Pat. No. 6,500,027 to Van Der Sanden is a seal for an electrical connection wherein a defined housing with at least one chamber for an electrical contact and a pressure plate with at least one through hole has a piece of insulating foam whose cells are filled with grease where the foam can be compressed during the connection of the electrical connector, expelling grease to surround and seal the connectors. This device simple provides a seal to protect the contacts from debris and moisture intrusion, but does not enhance conductivity.

U.S. Pat. No. 6,833,405 to Cottis, discloses a composition containing crystalline polymers which provide flame resisting properties, the composition containing a wholly aromatic polyester and a non-conductive filler material which renders the composition non-burning. It may also include a small amount of a non-volatile fluorescent brightener to improve the flame-retardant property of the resin. It is designated to be employed in electrical and electronic apparatuses.

In U.S. Pat. No. 5,962,122 to Walpita, a liquid crystalline polymer composition having a high dielectric constant is disclosed made from a thermotropic liquid crystalline and a ceramic having a dielectric constant which is greater than about 50 at a frequency of 1.0 GHz, the compositions having a dielectric constant of at least about 4, and preferably at least about 6, the compositions preferably having a low loss tangent. This composition is the polar opposite of the present invention. The present invention is intended to enhance conductivity, not to impede conductivity, as is a composition seeking to have a high dielectric constant, or very low electrical conductivity.

A product was located in a general search, the product known as PROHM-TECT®, which is disclosed in an MSDS sheet found on their Internet web site at www.prohm-tect-.com. The MSDS sheet indicates that the product is a petroleum hydrocarbon/metal mixture used at the manufactured stage for long-life, low-resistance, and corrosion-free electrical connections, or for later, where corrosion build-up has occurred. Although no patents are known, it is claimed that this company has been the world's leading supplier of compression conductive gels, greases and pastes for over 25 years.

II. SUMMARY OF THE INVENTION

Electrical connectors used in industrial and commercial applications have evolved over the years to provide better and more efficient connections and to reduce the resistance inherent in their use in electrical wiring and circuitry. These connectors are susceptible to degradation due to exposure to the elements, vibration, thermal cycling and movement resulting in loss of tolerance over time and tend to wear during repeated connection and disconnection, becoming loose and ill fitted. In addition, no matter how closely conforming, the terminal connectors do not have full contact on all surfaces.

Other problems encountered with electrical connectors include oxidation, environmentally induced corrosion, contamination by air, water, or minerals, vibration induced fretted corrosion, thermal cycling induced fretted corrosion, vibration induced interruption of electrical flow and vibration induced electrical noise. When viewed from a microscopic perspective, the "dry" interface between the connectors show multiple contact spots instead of a smooth contact.

The invention provides for a "wet" interface between static connector components by providing a flowable chemical emulsified compound to increase the contact area between the connector components and enhance the electrical conductivity between the connector components, while protecting the integrity of the electrical connection and actually improving conductivity, the compound comprising a base liquid with finely powdered metal with a thickening agent to increase and adjust the viscosity of the compound, depending on the target use of the product. Environmental stabilizers may also be included in the compound where environmental factors might be present to degrade the conductivity of the connector components over use and time.

Accordingly, the first objective of the flowable conductive compound is to provide an adaptive flowable chemical emulsified compound to enhance the electrical conductivity of a static electrical connection. A second objective of the compound is to reduce and possibly eliminate the degradation of the electrical connection over time. A third objective is to protect the electrical connection from environmental influence based on environmental factors where the electrical connection is to be utilized. A fourth objective is to provide the conductive compound in an adapted viscosity to eliminate or dampen vibration induced generation of electrical noise. A fifth objective is to reduce or eliminate intermittent loss of conductivity presented in the untreated electrical connectors, which eliminates noise produced in a loosely fitted electrical connector or by the operation of machine or other source of vibration in the vicinity of the electrical connection.

III. DESCRIPTION OF THE DRAWINGS

None.

IV. DESCRIPTION OF THE PREFERRED EMBODIMENT

A flowable liquid electrical conductive compound adapted to be applied to a set of electrical connectors to enhance the conductivity within the set of electrical connectors, to protect the integrity of the electrical connection within the set of electrical connectors and to reduce vibration caused loss of conductivity and generation of electrical noise which may be presented to the electrical connectors, the compound comprising essentially a quantity of powdered conductive metal, a base liquid to suspend the quantity of powdered conductive metal and a thickening agent component to provide a viscosity adapted to the particular use of the thermal and environmental applications of electrical connectors.

More specifically, the base liquid is a flowable liquid selected from a group consisting of mineral liquids, silicone liquids, ester liquids, petroleum hydrocarbon liquids, synthetic hydrocarbon liquids, phenyl ethers, polyglycols, polydimethyl silicone fluids, polydimethyl siloxane polymers, fluoro-silicone liquid or a mixture of two or more of them. The group may more specifically consist of poly-a-olefin, deters, pall esters, alkyl napthalene, alkylbenzene, plyoxalkylene glycol, polyphenyl ether, dialkyl diphenyl ether, castor oil liquid, or a compatible mixture of two or more of them. The specific base liquid is chosen based upon the type of metal in the electrical connectors, the powdered conductive metal and the compatibility with those metals, so as not to produce an adverse chemical reaction which would detract from conductivity or alter the metals or any surrounding adjacent construction materials attached to the electrical connectors, such as wiring insulation, by chemical means.

More specifically, the powdered conductive metal is specifically matched to the metal used in the electrical connectors to provide optimal conductivity with minimal reactivity to the metal used in the electrical connectors, the powdered conductive metal selected from a group consisting of brass, bronze, copper, inconel, molybdenum, molybdenum carbide, monel, nickel, silver, stainless steel, tin, zinc, gold, platinum and any alloy or combination thereof. The particulate size and shape of the conductive powdered metal is variable to relate to the size of the electrical connectors and to the electro-chemical, electro-mechanical and adjacent construction materials of the electrical connectors and attached wiring.

The thickening agent component is more specifically provided as a metal compatible grease selected from a group consisting of lithium soap, calcium soap, calcium complex soap, lithium complex soap, aluminum complex soap, sodium terephthalate, urea compounds, organic bentonite and silica.

In addition to the essentially disclosed compound, an environmental stabilizing component may also be added to prohibit environmental effects on the compound. The environmental stabilizer is adapted to the environment within which the electrical connector is intended to be used. The environmental stabilizing compound would be selected from a group consisting of an antifungal inhibiting additive, a fire and heat retardant additive, a color enhancing additive, an anti-corrosive additive, a rust inhibitor additive, a metal deactivating additive, an anti-oxidant additive or a combination of two or more of these additives. The environmental stabilizing component, if any, should be one having no adverse chemical reactions with the other components of the compound.

The anti-oxidant additive may be, for example, phenol compounds including but not limited to 2,6-di-t-butylphenol or 2,6-di-t-butyl-p-cresol, amine compounds including but not limited to dialkyldiphenylamine, phenyl-a-naphthylamine or polyphenyl-a-naphthylamine, or phenothiazine compounds. The color enhancing additive would be provided to enhance the pigment of the compound for a better visual indication of the amount and location of the applied compound in the electrical connector. The metal deactivating additive may include, but not be limited to benzothiazole, benzotraizole or sodium nitrate. The rust inhibitor may be provided, by example as a neutral or over-based petroleum, synthetic metal sulfonates, calcium sulfonates, barium sulfonates, zinc sufonates, metal soaps, partially esterified alcohols, fatty esters, amines, phosphoric acid or simple phosphates.

As indicated, the compound should be adapted for an intended use, which may include heavy machinery electrical connectors use in arid, humid or submerged environments, extremely small and delicate low voltage computer circuitry electrical connectors used in controlled environments, electrical connectors relative to high voltage electrical panels and circuitry in any environment, electrical connectors used in areas exposed to corrosive gasses, electrical connectors employed in underwater ocean equipment and research equipment exposed to seawater, electrical connectors used at varied altitudes, including a complete vacuum, and electrical connectors used near extremely high or extremely low temperature ranges, especially those in the aerospace industry.

When observed from a microscopic perspective, the "dry" or "as provided" electrical connectors do not make a full surface connection, due to their rigid nature. There are a multiplicity of contact points between a contact surface of a first electrical connector and a mated contact surface of a second electrical connector. A total area and number of the contact points is inversely proportional to the amount of a loss of electrical current, or directly proportional to the amount of resistance within the electrical connection. Over time, the electrical connectors are exposed to fretting corrosion, oxidation, environmentally induced corrosion, and metal fatigue caused by wear or repeated friction, which reduces the amount of contact points presented within the electrical connectors, and which may ultimately result in electrical connector failure and catastrophic damage to the machine operated by the electrical connectors.

By applying the compound to the respective contact surfaces of the electrical connectors, the powdered conductive metals within the compound bridge the gaps between the contact points providing more conductivity between the surfaces of the electrical connectors. The powdered conductive metals also etch, abrade and score the contact surfaces, becoming part of the contact surfaces over time, and creating more contact surface area and thus more efficient conductivity. The base liquid provides the compound with the "flowable" nature of the compound to uniformly distribute the compound upon the respective surfaces of the electrical connectors. The thickening agent component enhances the adhesion of the compound to the respective surfaces of the electrical connectors so that it does not run off or dissipate from the contact surfaces of the electrical connectors.

With the thickening agent component and the liquid, the compound provides a seal within the electrical connector which prohibits introduction of environmental contaminants to the contact surfaces of the electrical connectors, including water, oxygen, corrosive gasses, and non-conductive debris. Where oxygen is prohibited, oxidation is prohibited. Where water or other contaminants are prohibited, corrosion is prohibited.

Adding the environmental stabilizing component also reduces conductivity diminishing contaminants. The antifungal inhibiting additive thwarts biological growth within the electrical connectors, where exposure to the humidity and heat of a jungle environment is possible. The fire and heat retardant additive inhibits thermal degradation of the electrical connectors, or scorching of the contact surfaces of the electrical connectors and reduces heat exposure to surrounding materials in the event of an electrical short of the electrical connectors. The other environmental stabilizing components also have obvious useful benefits to the electrical connectors which would prove beneficial to the applied art.

The adaptive nature of the compound is provided by varying the concentration and proportional composition of the base liquid, conductive metal powder and the thickening agent component. For a thicker and heavier application, more thickening agent component, more powdered conductive metal or less base liquid would comprise the compound. For lighter and less viscosity, less thickening agent component or more base liquid might be used. It would be most beneficial to provide the compound as a pre-measured and mixed compound with a written description of the composition and intended application, environmental benefits per environmental application, a disclosure of contraindicated applications, and levels of viscosity. It would also be beneficial to provide such pre-measured and mixed compound in a delivery apparatus such as a syringe for light and precision application, a squeeze tube for moderate application or a caulk tube adapted to a caulk gun for heavy or thick applications. However, those delivery apparatuses are included as part of the claimed compound.

While the invention has been particularly shown and described with reference to a preferred embodiment thereof, it will be understood by those skilled in the art that changes in form and detail may be made therein without departing from the spirit and scope of the invention.

What is claimed is:

1. A method to enhance and preserve electrical conductivity between respective contact surfaces of electrical connectors, said method comprising:

providing said respective contact surfaces of electrical connectors; and providing a flowable liquid electrical conductive compound said compound comprising:

a quantity of powdered conductive metal wherein said powdered conductive metal is chemically matched to said electrical connectors to provide optimal conductivity with minimal reactivity to said electrical connectors, said powdered conductive metal selected from a group consisting of brass, bronze, inconel, molybdenum, molybdenum carbide, monel, nickel, stainless steel, platinum and alloys thereof, and or combination thereof;

a base liquid to suspend said quantity of powdered conductive metal, said base liquid providing said compound with a flowable character to uniformly distribute said compound upon said contact surfaces wherein said base liquid is selected from a group consisting of a mineral liquid, silicone liquid, ester liquid, petroleum hydrocarbon liquid, synthetic hydrocarbon liquid, phenyl ether, polyglycol, polydimethyl silicone fluids, polydimethyl siloxane polymers, fluoro-silicone liquid, poly-a-olefin, diesters, pall esters, alkyl naphthalene, alkyl benzene, polyoxyalkylene glycol, polyphenyl ether, dialkyl diphenyl ether, castor oil liquid, and a mixture of two or more of said group of base liquids; and a thickening agent component to provide a viscosity adapted to relative environmental applications of said electrical connectors, said thickening agent compound further causing said compound to adhere to said contact surfaces of said electrical connectors so that said compound does not run off or dissipate from said contact surfaces during application and use and wherein said thickening agent is a metal compatible grease selected from a group consisting of lithium soap, calcium soap, calcium complex soap, lithium complex soap, aluminum complex soap, sodium terephthalate, urea compounds, organic bentonite and silica;

applying said flowable liquid electrical conductive compound between said respective contact surfaces of electrical connectors; and etching, scoring, and incorporating said respective contact surfaces of electrical connectors with said quantity of powdered conductive metal in said flowable liquid electrical conductive compound during said applying of said flowable liquid electrical conductive compound and use thereof.

* * * * *